US011221188B2

(12) United States Patent
Marfione

(10) Patent No.: US 11,221,188 B2
(45) **Date of Patent: *Jan. 11, 2022**

(54) SUPPRESSOR FOR A FIREARM

(71) Applicant: Microtech Knives, Inc., Bradford, PA (US)

(72) Inventor: Anthony Marfione, Fletcher, NC (US)

(73) Assignee: Microtech Knives, Inc., Bradford, PA (US)

( * ) Notice: Subject to any disclaimer, the term of this patent is extended or adjusted under 35 U.S.C. 154(b) by 423 days.

This patent is subject to a terminal disclaimer.

(21) Appl. No.: 16/039,448

(22) Filed: Jul. 19, 2018

(65) Prior Publication Data

US 2019/0331449 A1 Oct. 31, 2019

Related U.S. Application Data

(63) Continuation of application No. 15/964,252, filed on Apr. 27, 2018, now Pat. No. 10,054,384.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 181/223; 89/14.4
See application file for complete search history.

(56) References Cited

U.S. PATENT DOCUMENTS 3,500,955 A 3/1970 Werbell
3,667,570 A * 6/1972 WerBell, III ..... F41A 21/30 181/223
3,713,362 A * 1/1973 Charron ..... F41A 21/30 89/14.4
4,291,610 A * 9/1981 Waiser ..... F41A 21/30 89/14.4
4,576,083 A 3/1986 Seberger, Jr.
4,588,043 A 5/1986 Finn
4,920,854 A 5/1990 Scanlon
5,029,512 A 7/1991 Latka
5,164,535 A 11/1992 Leasure
5,559,302 A 9/1996 Latka
6,575,074 B1 6/2003 Gaddini
(Continued)

FOREIGN PATENT DOCUMENTS

DE 25 40 419 A1 3/1977

*Primary Examiner* — Jeremy A Luks
(74) *Attorney, Agent, or Firm* — Steve LeBlanc, LLC

(57) ABSTRACT

A suppressor for a firearm includes a casing having a front end and defining a longitudinal axis. A first plurality of baffles are inside the casing, and a front cap is downstream from the first plurality of baffles at the front end of the casing. A first retainer is connected to the casing and disposed between the first plurality of baffles and the front cap. The first retainer has an upstream surface and a downstream surface, and the first plurality of baffles, the front cap, and the first retainer define a fluid pathway along the longitudinal axis. A contoured wall extends axially upstream from the upstream surface of the first retainer and defines a plurality of damping wells in the upstream surface of the first retainer radially disposed from the fluid pathway and circumferentially separated by the plurality of apertures. The downstream surface of the first retainer is symmetrical with the upstream surface.

17 Claims, 5 Drawing Sheets

(56) References Cited

U.S. PATENT DOCUMENTS

| | | | | |
|---|---|---|---|---|
| 7,073,426 | B1 * | 7/2006 | White | F41A 21/30 181/223 |
| 7,308,967 | B1 * | 12/2007 | Hoel | F41A 21/30 181/223 |
| 7,931,118 | B1 | 4/2011 | Cronhelm | |
| 8,522,662 | B2 * | 9/2013 | Presz, Jr. | F41A 21/30 89/14.3 |
| 8,991,550 | B2 * | 3/2015 | Coley | F41A 21/30 181/223 |
| 9,188,403 | B1 * | 11/2015 | White | F41A 21/34 |
| 9,470,466 | B2 | 10/2016 | Washburn, III et al. | |
| 9,476,661 | B2 * | 10/2016 | Troy | F41A 21/30 |
| 9,702,651 | B2 * | 7/2017 | Petersen | F41A 21/30 |
| 10,054,384 | B1 * | 8/2018 | Marfione | F41A 21/30 |
| 10,415,917 | B2 * | 9/2019 | White | F41A 21/38 |
| 2012/0152649 | A1 | 6/2012 | Larue | |
| 2014/0224575 | A1 * | 8/2014 | Latka | F41A 21/30 181/223 |
| 2015/0253099 | A1 * | 9/2015 | Shults | F41A 21/34 181/223 |
| 2015/0285576 | A1 * | 10/2015 | Shults | F41A 21/325 89/14.2 |
| 2016/0187093 | A1 * | 6/2016 | Barrett | F41A 21/28 89/14.4 |
| 2017/0350669 | A1 | 12/2017 | Latka | |

* cited by examiner

SUPPRESSOR FOR A FIREARM

RELATED APPLICATIONS

The present application is a Continuation of U.S. Patent Application entitled "Suppressor for a Firearm," Ser. No. 15/964,252 filed on Apr. 27, 2018, all of which is hereby incorporated herein by reference in its entirety for all purposes. Any disclaimer that may have occurred during prosecution of the above-referenced application is hereby expressly rescinded.

FIELD OF THE INVENTION

The present invention generally involves a suppressor for a firearm.

BACKGROUND OF THE INVENTION

A conventional firearm operates by combusting gunpowder or other accelerant to generate combustion gases that propel a projectile through a barrel and out of the muzzle. The rapidly expanding combustion gases exit the muzzle to produce a characteristic loud bang commonly associated with gunfire.

A suppressor (also commonly referred to as a silencer) is a device attached to the muzzle of the firearm to dissipate energy of the combustion gases to reduce the noise signature of the firearm. The suppressor generally includes a number of baffles serially arranged or stacked inside a casing. A longitudinal pathway through the baffle stack allows the projectile to pass through the suppressor unobstructed, while the baffle stack redirects the combustion gases inside the casing to allow the combustion gases to expand, cool, and otherwise dissipate energy before exiting the suppressor. The combustion gases thus exit the suppressor with less energy, reducing the noise signature associated with the discharge of the firearm.

While numerous suppressor designs exist to reduce the noise signature of a firearm, the need exists for continued improvements that further reduce the noise signature of a firearm. In particular, improvements in axially supporting the baffle stack and conditioning the combustion gases downstream from the baffle stack before exiting the suppressor may enhance the expansion, cooling, and/or energy dissipation of the combustion gases passing through the suppressor, reducing the noise signature associated with the discharge of the firearm.

BRIEF DESCRIPTION OF THE INVENTION

Aspects and advantages of the invention are set forth below in the following description, or may be obvious from the description, or may be learned through practice of the invention.

One embodiment of the present invention is a suppressor for a firearm. The suppressor includes a casing having a front end and defining a longitudinal axis. A first plurality of baffles are inside the casing, and a front cap is downstream from the first plurality of baffles at the front end of the casing. A first retainer is connected to the casing and disposed between the first plurality of baffles and the front cap. The first retainer has an upstream surface and a downstream surface, and the first plurality of baffles, the front cap, and the first retainer define a fluid pathway along the longitudinal axis. A contoured wall extends axially upstream from the upstream surface of the first retainer and defines a plurality of damping wells in the upstream surface of the first retainer radially disposed from the fluid pathway and circumferentially separated by the plurality of apertures. The downstream surface of the first retainer is symmetrical with the upstream surface.

An alternate embodiment of the present invention is a suppressor for a firearm that includes a casing having a front end and defining a longitudinal axis. A plurality of baffles are inside the casing, and a front cap is downstream from the plurality of baffles at the front end of the casing, wherein the front cap defines an axial length. A first retainer is in threaded engagement with the casing and disposed upstream from the plurality of baffles, and a second retainer is in threaded engagement with the casing and disposed downstream from the plurality of baffles and upstream from the front cap. The plurality of baffles, the front cap, and the first and second retainers define a fluid pathway along the longitudinal axis. Each retainer includes an upstream surface and a downstream surface and a plurality of apertures through the upstream and downstream surfaces and radially disposed from the fluid pathway that provide fluid communication through the upstream and downstream surfaces. The downstream surface of each retainer is symmetrical with the upstream surface.

In yet another embodiment of the present invention, a suppressor for a firearm includes a casing having a front end and defining a longitudinal axis. A front cap is at the front end of the casing. The front cap has an axial length, and a cylindrical tube extends upstream in the front cap more than 50% of the axial length of the front cap. A first retainer in threaded engagement with the casing and disposed upstream from the front cap has an upstream surface and a downstream surface. A first plurality of baffles are inside the casing and upstream from the first retainer. The front cap, the first retainer, and the first plurality of baffles define a fluid pathway along the longitudinal axis. The downstream surface of the first retainer is symmetrical with the upstream surface.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
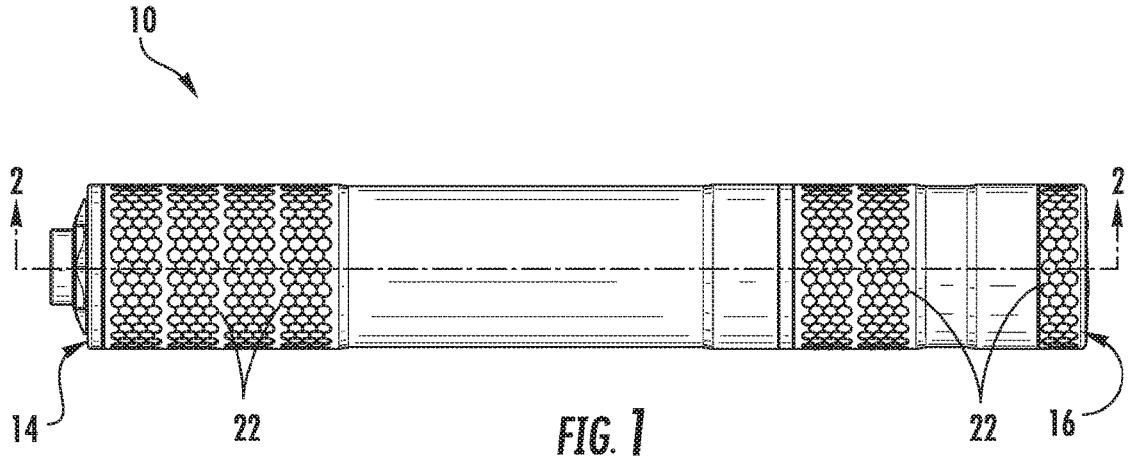
FIG. 1 is a side plan view of a suppressor according to one embodiment of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. As used herein, the terms "upstream" and "downstream" refer to the relative location of components in a fluid pathway. For example, component A is upstream of component B if a fluid flows from component A to component B. Conversely, component B is downstream of component A if component B receives a fluid flow from component A. As used herein, the term "axial" refers to a direction of flow through an object; the term "radial" refers to a direction extending away from the center of an object or normal to the "axial" direction, and the term "circumferential" refers to a direction extending around the circumference or perimeter of an object.

Figure 2:
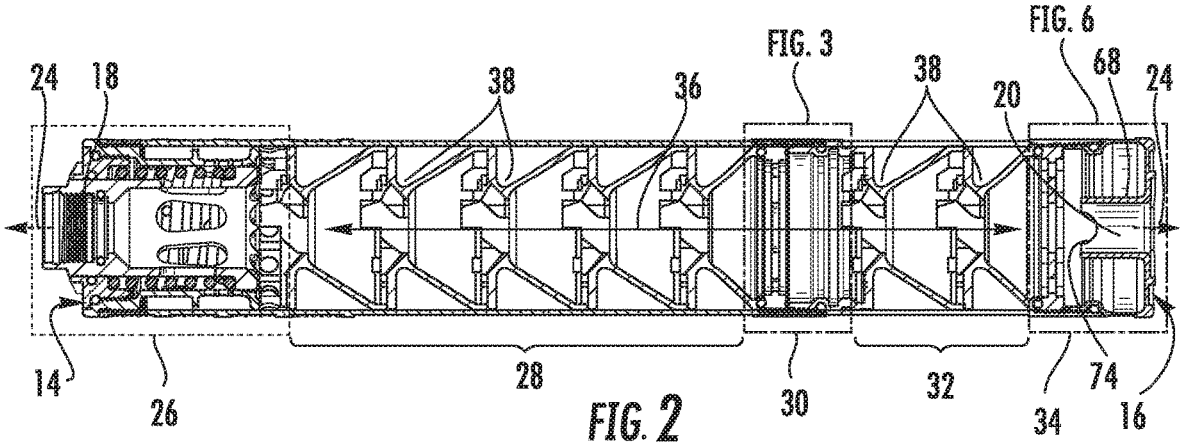
FIG. 2 is a side cross-section view of the suppressor shown in FIG. 1 taken along line 2-2.

Embodiments of the present invention provide a suppressor for a firearm with improved sound damping and/or thermal performance compared to existing suppressor designs. FIG. 1 provides a side plan view of a suppressor 10 according to one embodiment of the present invention, and FIG. 2 provides a side cross-section view of the suppressor 10 shown in FIG. 1 taken along line 2-2. As shown in FIGS. 1 and 2, the suppressor 10 generally includes a casing 12 that contains the internal components of the suppressor 10 and provides the structure for connecting the suppressor 10 to the firearm. For convention, a rear end 14 of the casing 12 refers to the end of the casing 12 that connects to the firearm, and a front end 16 of the casing 12 refers to the opposite end of the casing 12 from which a bullet or other projectile exits. The rear end 14 of the casing 12 generally includes threads 18 or other structure known in the art for attaching the suppressor 10 to the muzzle end of the firearm. The front end 16 of the casing 12 generally terminates in an opening 20 through which the bullet or other projectile from the firearm passes. The casing 12 may further include various textured surfaces 22 between the rear and front ends 14, 16 to facilitate handling and gripping the suppressor 10.

As shown in FIG. 2, the casing 12 generally defines a longitudinal axis 24 for the suppressor 10 and contains the internal components of the suppressor 10. The casing 12 and internal components of the suppressor 10 may be constructed from any material suitable for exposure to the pressures and temperatures normally associated with the discharge of a firearm. For example, in particular embodiments, the casing 12 and internal components of the suppressor 10 may be constructed from metal, fiberglass, carbon, polymers, or other composite materials known in the art. The casing 12 is typically cylindrical, although the particular geometry of the casing 12 is not a limitation of the present invention unless specifically recited in the claims.

In the particular embodiment shown in FIG. 2, the suppressor 10 generally includes a rear baffle stack support assembly 26, a baffle stack assembly 28, an extension interface 30, an extension module 32, and a front cap assembly 34 that define a fluid pathway 36 along the longitudinal axis 24 through the suppressor 10. The rear baffle stack support assembly 26 generally includes structure for connecting the suppressor 10 to the firearm, as well as structure for pre-conditioning the combustion gases upstream of the baffle stack assembly 28. The baffle stack assembly 28 generally includes a series of baffles 38 in a stacked relationship to further cool and reduce the energy of the combustion gases. For example, as shown in FIG. 2, the baffle stack assembly 28 may include five baffles 38 sequentially stacked together. The extension interface 30 provides axial support to upstream baffles 38 and expansion capability to add additional baffles 38 in the extension module 32, if so desired. The front cap assembly 34 provides additional axial support to the upstream baffles 38 and further conditions the combustion gases before exiting the suppressor 10 to enhance the expansion, cooling, and/or energy dissipation of the combustion gases passing through the suppressor 10.

Figure 3:
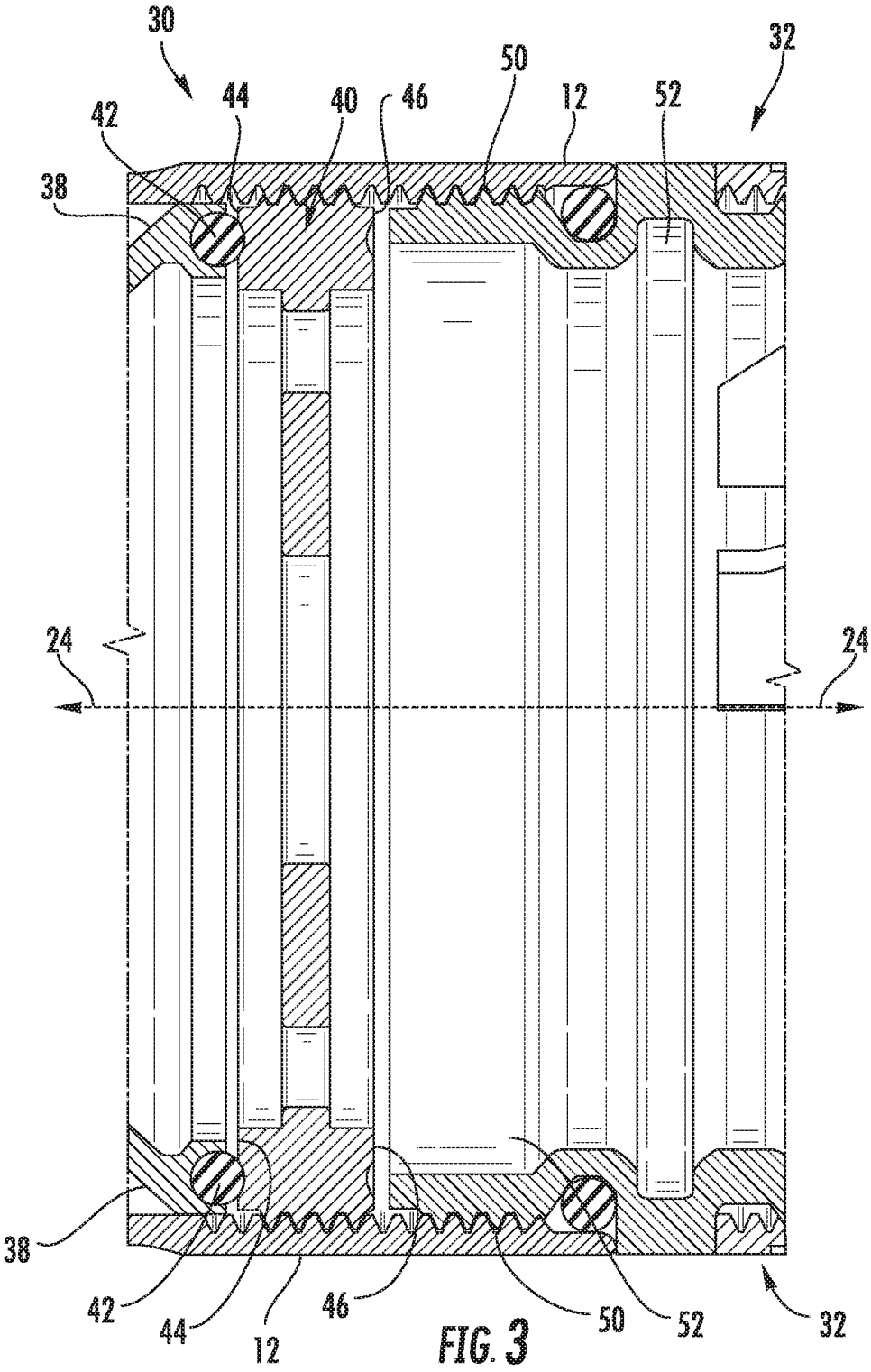
FIG. 3 is an enlarged view of the extension interface shown in FIG. 2.

FIG. 3 provides an enlarged view of the extension interface 30 shown in FIG. 2. As shown in FIG. 3, the extension interface 30 includes a retainer 40 and an annular compression ring 42 between the retainer 40 and the upstream baffles 38. The retainer 40 has an upstream surface 44 axially opposed to a downstream surface 46 and is connected to the casing 12. For example, as shown in FIG. 3, the retainer 40 may be in threaded engagement with the casing 12 to facilitate assembly and disassembly of the internal components of the suppressor 10. Once connected to the casing 12, the retainer 40 provides axial support to hold the upstream baffles 38 in place. The annular compression ring 42 extends circumferentially between the immediately upstream baffle 38 and the retainer 40 to provide a fluid seal between the retainer 40 and the immediately upstream baffle 38. In addition, thermal expansion and contraction may cause the upstream baffles 38 to shift axially, and the annular compression ring 42 expands and compresses axially as needed to absorb this axial movement.

Downstream from the retainer 40, the extension interface 30 is configured to receive either an extension module 32, if more baffles 38 are desired, or a front cap 48, terminating the suppressor 10. In the particular embodiment shown in FIGS. 1-3, for example, additional threads 50 in the casing 12 downstream from the retainer 42 may provide a threaded engagement with an adapter 52 for the extension module 32. As shown in FIG. 2, the extension module 32 includes two additional baffles 38 downstream from the retainer 40, between the extension interface 30 and the front cap assembly 34. If additional baffles 38 are not desired, then the threads 50 downstream from the retainer 42 may provide a threaded engagement with the front cap 48, as will be described with respect to FIG. 6.

Figure 4:
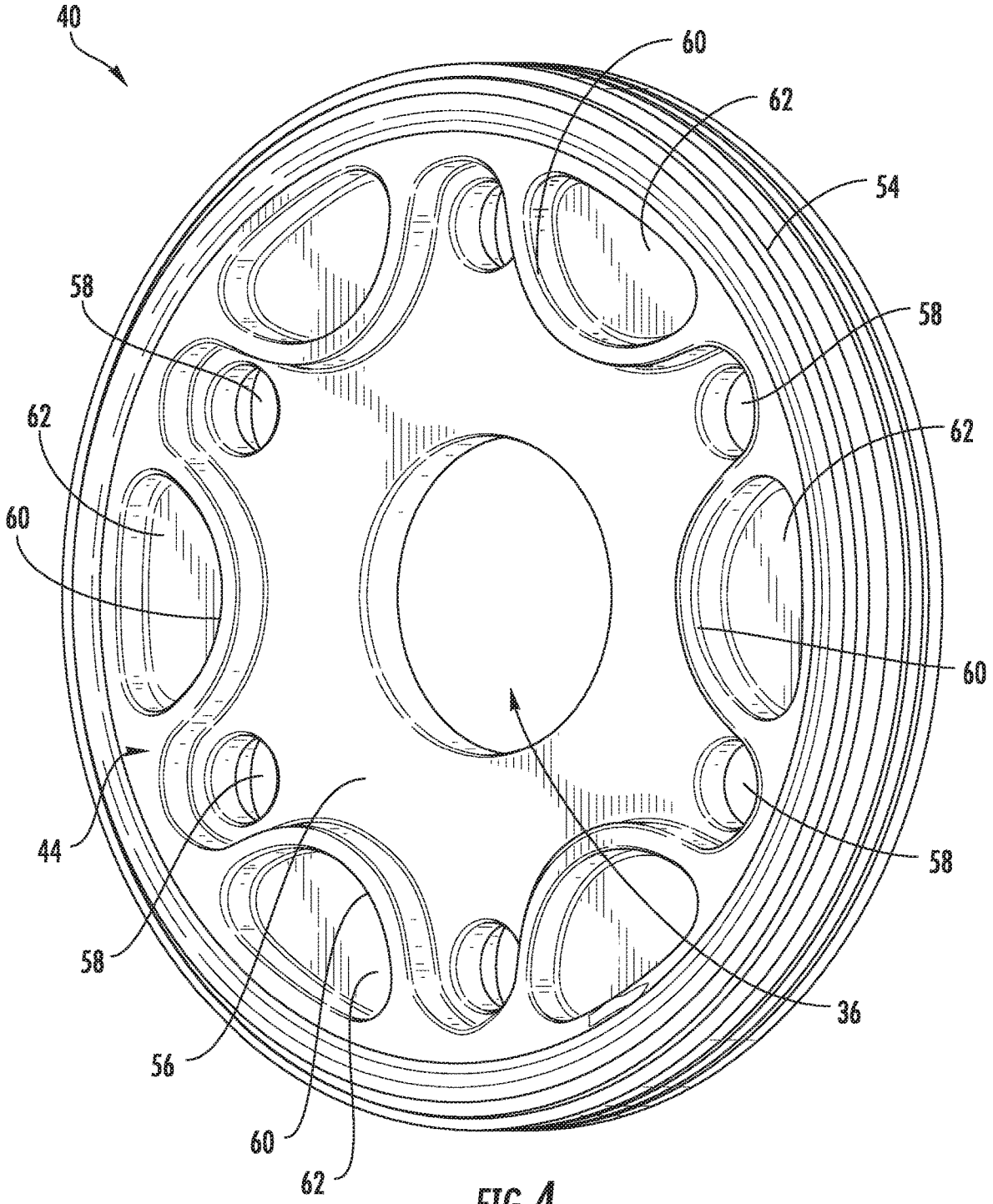
FIG. 4 is an upstream perspective view of a retainer according to one embodiment of the present invention.
Figure 5:
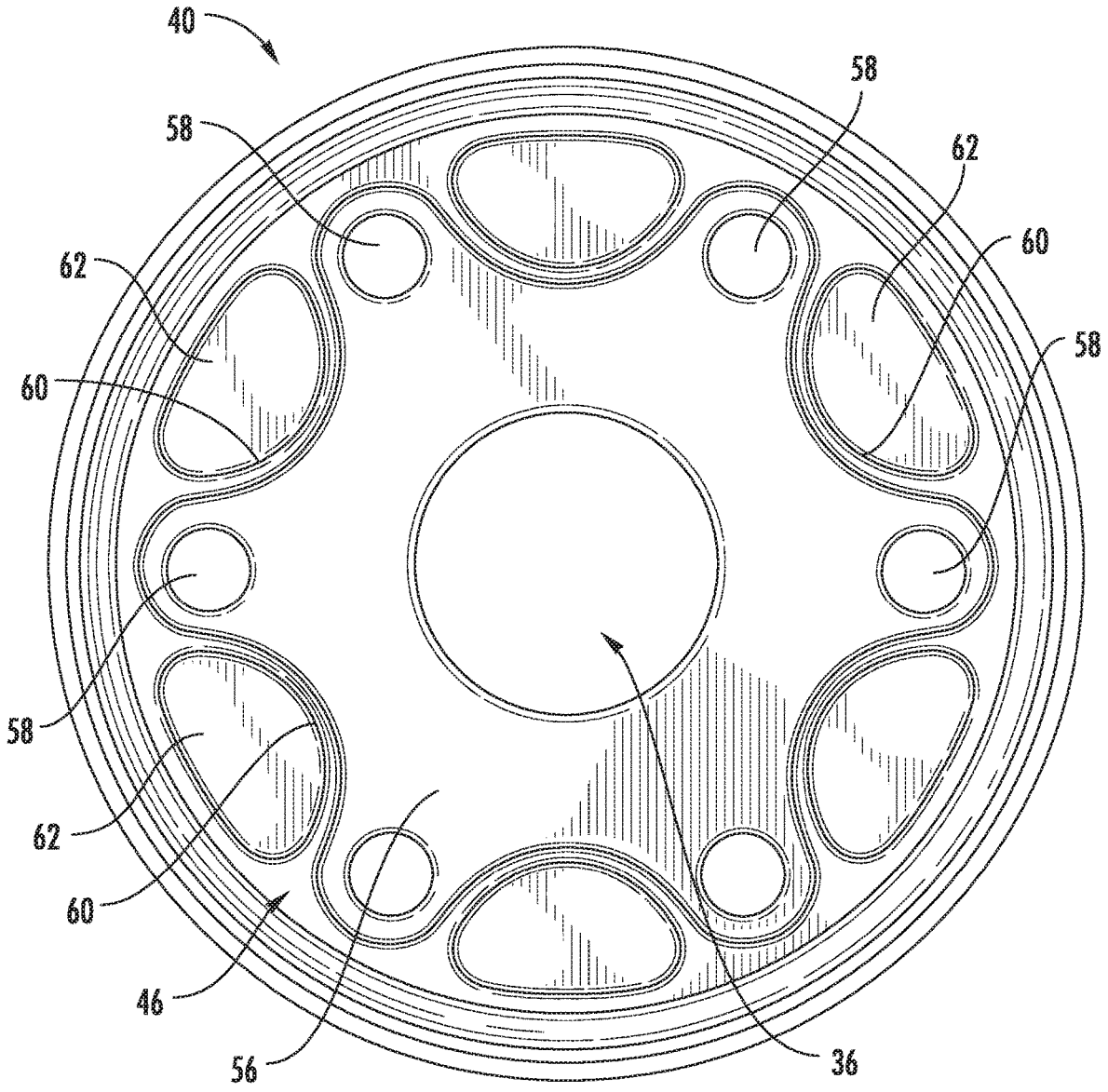
FIG. 5 is a downstream plan view of the retainer shown in FIG. 4.

FIG. 4 provides an upstream perspective view of the retainer 40 according to one embodiment of the present invention, and FIG. 5 provides a downstream plan view of the retainer 40 shown in FIG. 4. As shown in FIGS. 4, and 5, the upstream and downstream surfaces 44, 46 are substantially identical or symmetrical, simplifying assembly by allowing the retainer 40 to be installed in the casing 12 in either direction. The retainer 40 may be cylindrical in shape to conform to the internal volume of the casing 12. Threads 54 around the outer circumference of the retainer 40 may provide threaded engagement between the retainer 40 and the casing 12.

The retainer 40 includes several structural features that enhance the expansion, cooling, and/or energy dissipation of the combustion gases passing through the suppressor 10. For example, a substantially flat surface 56 on the upstream and downstream surfaces 44, 46 defines the fluid pathway 36 along the longitudinal axis 24 of the casing 12. It is believed that the substantially flat surface 56 adjacent to the fluid pathway 36 reduces the amount of turbulent flow in the immediate vicinity of the fluid pathway 36 to reduce any heating of the combustion gases flowing through the fluid pathway 36.

A plurality of apertures 58 radially disposed from the fluid pathway 36 pass through the upstream and downstream surfaces 44, 46 of the retainer 40. The apertures 58 provide an additional flow path for combustion gases through the retainer 40 that is not through the fluid pathway 36.

A contoured wall 60 extends axially upstream from the upstream surface 44 and downstream from the downstream surface 46 to form or define a plurality of damping wells 62 in the upstream and downstream surfaces 44, 46. As shown in FIGS. 4 and 5, the damping wells 62 may be radially disposed from the fluid pathway 36 and circumferentially separated by the apertures 58. The contoured wall 60 and resulting damping wells 62 provide several advantages over existing designs to enhance the performance of the suppressor 10. For example, the additional surface area provided by the contoured wall 60 increases cooling to the combustion gases flowing through the suppressor 10. The increased cooling in turn reduces the pressure and velocity of the combustion gases, providing a corresponding reduction in the energy of the combustion gases exiting the suppressor 10. In addition, the perimeters formed by the contoured wall 60 create separate damping wells 62 that further disrupt the flow of combustion gases through the suppressor 10, thereby further reducing the velocity of the combustion gases.

As previously described and shown in FIG. 2, the extension module 32 connects between the extension interface 30 and the front cap assembly 34 to provide additional baffles 38 inside the casing 12. As with the extension interface 30, the downstream end of the extension module 32 is configured to receive either another extension module 32, if more baffles 38 are desired, or the front cap assembly 34, terminating the suppressor 10.

Figure 6:
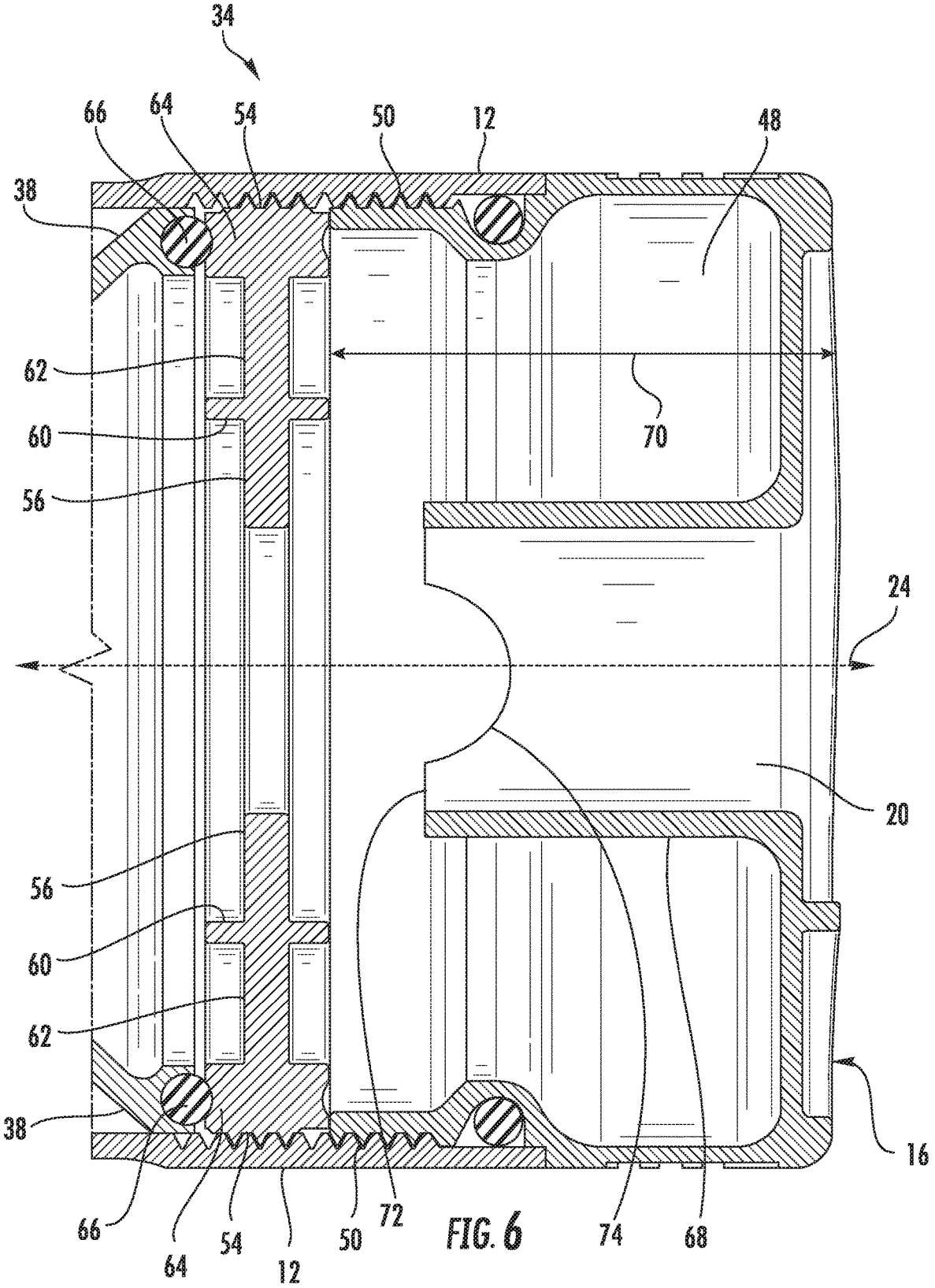
FIG. 6 is an enlarged view of the front cap assembly shown in FIG. 2.

FIG. 6 provides an enlarged view of the front cap assembly 34 shown in FIG. 2. As shown in FIG. 6, the interface between the extension module 32 and the front cap assembly 34 includes a second retainer 64 and second annular compression ring 66 as previously described and illustrated with respect to FIGS. 3-5. Specifically, the second retainer 64 is symmetrical and includes the threads 54, flat surface 56, apertures 58, contoured wall 60, and damping wells 62 as shown in FIGS. 4 and 5. In addition, the second annular compression ring 64 is disposed between the second retainer 62 and the upstream baffles 38 to provide a fluid seal between the second retainer 62 and the immediately upstream baffle 38 and to expand and compress axially to absorb axial movement of the upstream baffles 38.

As shown in FIG. 6, the front cap 48 is in threaded engagement with the casing 12 at the front end 16 of the suppressor 10. The opening 20 in the front cap 48 defines the fluid pathway 36 along the longitudinal axis 24 to allow the projectile and combustion gases to exit the suppressor 10. As shown in FIGS. 2 and 6, the opening 20 may be defined by a cylindrical tube 68 that extends upstream from the front end 16 of the suppressor 10. In particular embodiments, the cylindrical tube 68 may extend upstream from the front end 16 of the suppressor 10 more than 25% or 50% of an axial length 70 of the front cap 48. In addition, as shown most clearly in FIG. 6, the cylindrical tube 68 may include an upstream end 72 with an arcuate relief 74 at the upstream end 72. It is believed that the cylindrical tube 68 in conjunction with the arcuate relief 74 further dampens noise from the suppressor 10 by enhancing the expansion, cooling, and/or energy dissipation of the combustion gases prior to exiting the front cap 48 of the suppressor 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A suppressor for a firearm, comprising:

a casing having a front end and defining a longitudinal axis;

a first plurality of baffles inside said casing;

a front cap downstream from said first plurality of baffles at said front end of said casing;

a first retainer connected to said casing and disposed between said first plurality of baffles and said front cap, wherein said first retainer has an upstream surface and a downstream surface, and wherein said first plurality of baffles, said front cap, and said upstream surface of said first retainer define a fluid pathway along said longitudinal axis;

a contoured wall that extends axially upstream from said upstream surface of said first retainer, wherein said contoured wall defines a plurality of damping wells in said upstream surface of said first retainer radially disposed from said fluid pathway; and wherein said downstream surface of said first retainer is symmetrical with said upstream surface.

2. The suppressor as in claim 1, further comprising a substantially flat surface on said upstream surface of said first retainer between said contoured wall and said fluid pathway.

3. The suppressor as in claim 1, further comprising a first annular compression ring between said first plurality of baffles and said first retainer.

4. The suppressor as in claim 1, further comprising a second plurality of baffles inside said casing and downstream from said first retainer.

5. The suppressor as in claim 4, further comprising a second retainer connected to said casing and disposed between said second plurality of baffles and said front cap.

6. The suppressor as in claim 5, wherein said second retainer is identical to said first retainer.

7. The suppressor as in claim 5, further comprising a second annular compression ring between said second plurality of baffles and said second retainer.

8. The suppressor as in claim 1, wherein said front cap has an axial length and a cylindrical tube extends upstream in said front cap more than 50% of said axial length of said front cap.

9. A suppressor for a firearm, comprising:

a casing having a front end and defining a longitudinal axis;

a plurality of baffles inside said casing;

a front cap downstream from said plurality of baffles at said front end of said casing, wherein said front cap defines an axial length;

a first retainer in threaded engagement with said casing and disposed upstream from said plurality of baffles;

a second retainer in threaded engagement with said casing and disposed downstream from said plurality of baffles and upstream from said front cap, wherein said plurality of baffles, said front cap, and said first and second retainers define a fluid pathway along said longitudinal axis;

wherein each retainer comprises:

an upstream surface and a downstream surface;

a plurality of apertures through said upstream and downstream surfaces and radially disposed from said fluid pathway, wherein said plurality of apertures provide fluid communication through said upstream and downstream surfaces; and wherein said downstream surface of each retainer is symmetrical with said upstream surface.

10. The suppressor as in claim 9, further comprising a substantially flat surface on said upstream surface of each retainer between said plurality of apertures.

11. The suppressor as in claim 9, further comprising an annular compression ring upstream from each retainer.

12. The suppressor as in claim 9, further comprising a cylindrical tube in said front cap that extends upstream in said front cap more than 50% of said axial length of said front cap.

13. A suppressor for a firearm, comprising:

a casing having a front end and defining a longitudinal axis;

a front cap at said front end of said casing, wherein said front cap has an axial length and a cylindrical tube extends upstream in said front cap more than 50% of said axial length of said front cap;

a first retainer in threaded engagement with said casing and disposed upstream from said front cap, wherein said first retainer has an upstream surface and a downstream surface, a first plurality of baffles inside said casing and upstream from said first retainer, wherein said front cap, said first retainer, and said first plurality of baffles define a fluid pathway along said longitudinal axis;

a substantially flat surface extends radially outward from said fluid pathway on said upstream surface of said first retainer; and wherein said downstream surface of said first retainer is symmetrical with said upstream surface;

and further comprising a first annular compression ring between said first plurality of baffles and said first retainer.

14. The suppressor as in claim 13, further comprising a second plurality of baffles inside said casing and downstream from said first retainer.

15. The suppressor as in claim 14, further comprising a second retainer in threaded engagement with said casing and disposed between said second plurality of baffles and said front cap.

16. The suppressor as in claim 15, wherein said second retainer is identical to said first retainer.

17. The suppressor as in claim 13, wherein said cylindrical tube has an upstream end with an arcuate relief in said upstream end of said cylindrical tube.

* * * * *